US012246369B2

(12) United States Patent
Djuric

(10) Patent No.: US 12,246,369 B2
(45) Date of Patent: Mar. 11, 2025

(54) PRESS BRAKE SAFETY LATCH

(71) Applicant: ACCURPRESS AMERICA INC., Rapid City, SD (US)

(72) Inventor: Dragisa Djuric, Rapid City, SD (US)

(73) Assignee: Accurpress America Inc., Rapid City, SD (US)

( * ) Notice: Subject to any disclaimer, the term of this patent is extended or adjusted under 35 U.S.C. 154(b) by 0 days.

(21) Appl. No.: 17/320,186

(22) Filed: May 13, 2021

(65) Prior Publication Data

US 2022/0362826 A1 Nov. 17, 2022

(51) Int. Cl.
*B21D 5/02* (2006.01)
*B21D 55/00* (2006.01)

(52) U.S. Cl.
CPC ..... *B21D 5/0236* (2013.01); *B21D 55/00* (2013.01)

(58) Field of Classification Search
CPC ..... B21D 55/00; B21D 5/0236
See application file for complete search history.

(56) References Cited

U.S. PATENT DOCUMENTS

| | | | | |
|---|---|---|---|---|
| 6,467,327 | B1 | 10/2002 | Runk et al. | |
| 8,099,992 | B2 | 1/2012 | Rouweler et al. | |
| 9,254,517 | B2 | 2/2016 | Sato et al. | |
| 2003/0033846 | A1 | 2/2003 | Runk et al. | |
| 2015/0143867 | A1* | 5/2015 | Sato | B21D 5/0254 72/482.93 |
| 2016/0229078 | A1 | 8/2016 | Thielges | |
| 2018/0071805 | A1 | 3/2018 | Sundquist et al. | |
| 2018/0085807 | A1* | 3/2018 | Morgan | B21D 5/0236 |
| 2019/0388946 | A1 | 12/2019 | Rouweler et al. | |

FOREIGN PATENT DOCUMENTS

| | | | | |
|---|---|---|---|---|
| EP | 494 714 | B1 | 4/1997 | |
| JP | 2003-230922 | A | 8/2003 | |
| JP | 2018-505061 | A | 2/2018 | |
| KR | 2015-0077734 | A | 7/2015 | |
| WO | WO00/30781 | * | 6/2000 | |
| WO | WO-0030781 | A1 * | 6/2000 | B21D 5/0209 |

OTHER PUBLICATIONS

International Search Report and Written Opinion mailed Aug. 31, 2022 issued in related International Patent Application No. PCT/US2022/029306; filed May 13, 2022.

* cited by examiner

*Primary Examiner* — Christopher L Templeton
*Assistant Examiner* — P Derek Pressley
(74) *Attorney, Agent, or Firm* — Gordon Rees Scully & Mansukhani, LLP

(57) ABSTRACT

A press brake assembly configured to bend a workpiece that includes an upper beam configured to hold an upper punch and a lower beam configured to hold a lower die. A safety latch is disposed within a safety latch cavity of the upper punch, and the upper punch is partially housed within a first cavity of the upper beam. A biasing member is also disposed within the safety latch cavity. A pin extends from a lateral side of the upper punch through the safety latch, and the safety latch is configured to rotate about the pin. The safety latch includes a cam configured to engage the upper beam within a second cavity of the upper beam. The biasing member is configured to bias the cam in a forward direction towards the upper beam cavity to prevent the upper punch from disengaging the upper beam.

14 Claims, 7 Drawing Sheets

PRESS BRAKE SAFETY LATCH

The present disclosure relates to a press brake system. In particular, a safety latch assembly for a press brake die.

Metal forming on sheet metal typically incorporates the use of a metal forming press brake consisting of two forming assemblies which are pressed against one another by the press brake. The two actionable components are typically an upper ram assembly which consists of a heavy metal ram, a die holder that clamps and holds a forming die that is driven down into a stable forming die mounted on the lower bed assembly with a clamping system to hold the lower die in place while metal forming is performed. Both upper and lower sides of the forming operation contain tool holders designed to act as mechanisms to hold the forming dies, or in some cases the lower tooling acts as its own forming die. Both tool holders can be locked into stable holding positions with some type of tool clamping mechanism. The lower die is stable in its holder and is not subject to creating a safety hazard when the clamping mechanism is un-clamped. However, the upper die is subject to gravity when clamping is removed and subsequently has been the subject of safety measures to ensure that falling hazards are mitigated by the design in both the upper tool holder as well as the tooling being held by the holder.

The tool holders have developed in different manner over the years and the current group of tool holders are designed to hold dies based upon the types of tongues on the dies, these are commonly referred to by the names, American Standard, New American Standard, New Standard, or European Standard. Other styles by different names in use around the world are not excluded by remaining unnamed. (No figures of these various die holders are provided.) These tool holders are typically formed with safety standards incorporated into their design to help prevent the upper die from falling free and creating safety hazards to the extent possible. A current standard safety feature most commonly in use by tool holder manufacturers is a safety channel (or a pair of safety channels) that follows the horizontal length of the upper tool holder. This safety channel is engaged with a safety catch that entraps the upper die to prevent falling tools when the clamping system of the upper tool holder is released.

There are numerous methods incorporated to hold the upper die within this safety channel on the tool holder. Each method has a unique set of characteristics and likewise its own inherent potential issues that can affect performance both in a positive and negative manner.

Several safety designs resort to a mechanical linkage that engages a latch or a cammed protrusion which is designed to extend or engage into the safety channel of the upper tool holder. These safety latches are held in place by some type of resilient holding system that is required to hold the latch in place in the event of the press brake losing power or the release of the tool clamping system that holds the die in place while forming material. The safety latching designs are also typically expected to allow for safe removal of the upper die for expected tooling changes in the metal forming processes. The current state of art for these safety latching methods do not take into consideration that there is a potential failure aspect which can occur in the latching mechanism itself wherein the latching components and design are subject to environmental hazards or other weaknesses in the latch method design that result in wear or fracture failures.

There are three areas of concern in the design of safety latching mechanisms. First, the components that make up the latching method are manufactured with materials subject to degradation over time due to environmental hazards, (i.e., the normal working environment of a metal forming shop typically results in the generation of debris, metal shards and detritus along with oils, greases, and other contaminants which will penetrate the housing cavities that contain the mechanisms of the safety latch); the hazards either individually or in combinations can create binding, wearing and fracturing failures of the components.

Second is the potential which results in variances in manufacturing with any metal materials used in tooling manufacturing. These variables can and do create failures (i.e., manufacturing defects) in metal components. Manufacturers attempt to engineer these failures from their production, but it is inevitable in any line of tooling manufacture.

The third concern is the design of the safety latching/release mechanism. The typical method in use until now has been the utilization of the latch holding mechanisms where the resilient member that maintains the force to hold the latch into the safety channel of the upper die holder, is offset vertically from the horizontal force required to hold the latch in place. That design relies upon the structural integrity of the latch material and the components of assembly (i.e., pins, screws, and other variety of components) to hold the safety latch in position. However, in the event of a fracture or failure of the latching method or any of the mechanisms to operate/release the die safety, an unforeseen hazard exists. Because the typical spring or other resilient member is mounted below the line of horizontal force required to hold the latch in place, any failure point creates the possibility for the latch to fall out of the upper tool holder safety channel when the latch body fractures or with other component failures.

Current safety latches used on press brake tooling in the upper die fixture have demonstrated failures resulting from the environment conditions of manufacturing and design issues of the safety mechanisms as discussed above. Current designs are created with precision enclosed machined spaces which when exposed to contamination are especially vulnerable to failures from binding and excessive wear. The contaminants collect within these spaces and create wear or binding of these clasping methods and are known to cause failures in the safety clasp mechanical components, causing them to break or bind and then create a failure to maintain the upper die in place when machine clamping is removed. Enclosed mechanisms are also subject to progressive wear because the enclosures are machined to such tight tolerances. The internal assemblies are not readily observable and are not recognizable by operators as a potential hazard and thus create opportunity for unexpected failures when performing die changes. The issue with manufacturing defects in components are not typically recognized by the tooling manufacturer nor at the tool owner locations until there is a collection of failures occurring in common. These failures appear random and the defects can be exacerbated by contamination issues.

When current safety clasping methods fail (regardless of reason), the failure points are often fractures at stress points on the clasping body of the safety component or at the assembly junctions of the safety component. The cammed clasp of the designed safety mechanism which is held in the safety channel of the upper die clamp by some form of resilient compression device, fails to hold in that channel because the resilient device is located at a point that is below the safety latch cam and the safety channel of the upper tool holder. The resulting failure or fracture of some part within the safety device removes the tension from the clasp and allows the clasp to either retract from the safety channel or renders it incapable of holding the weight of the die within the safety channel. The tool is then subject to gravity and is permitted to fall when clamping pressure is removed causing a significant safety hazard.

As described herein, an improved safety latching system is provided in order to address the concerns discussed above.

BRIEF DESCRIPTION OF THE DRAWINGS

The features, aspects, and advantages of the disclosed deliver system will become apparent from the following description, and the accompanying exemplary embodiments shown in the drawings, which are briefly described below.

DETAILED DESCRIPTION

Figure 1:
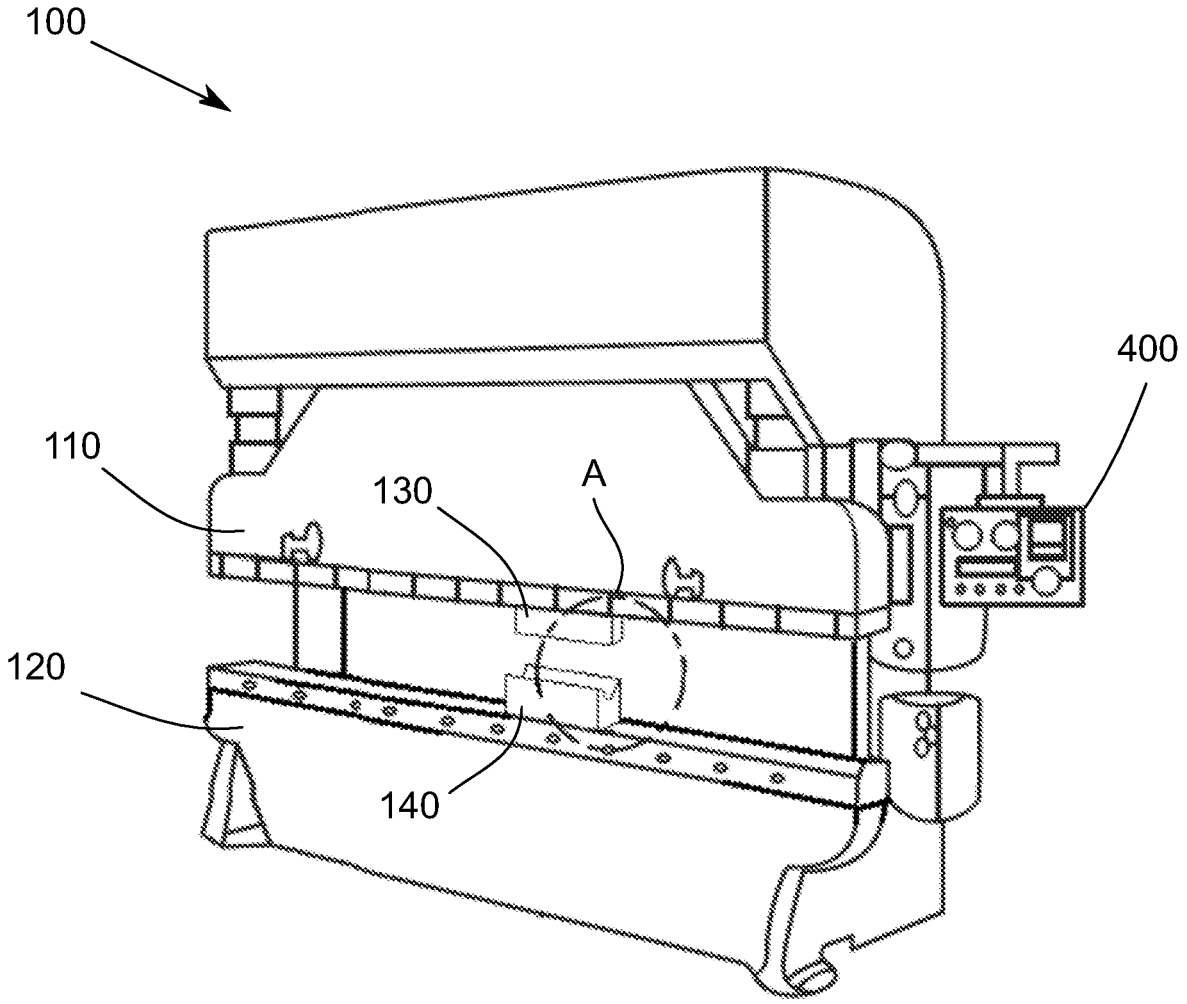
FIG. 1 is an isometric view of an exemplary press brake.

The press brake machine described herein may be structured, for example, in the manner of the press brake machine disclosed in application Ser. No. 16/541,021, filed on Aug. 14, 2019 (incorporated by reference herein in its entirety). An exemplary press brake machine may include a ram located above a bed. The machine may include one or more hydraulic cylinders that force the ram (and a connected punch) downward toward the bed (and a connected die). Alternatively, the force of hydraulic pressure may be used to force the bed upward. The press brake machine processes a workpiece (e.g., sheet metal) through bending the workpiece to a desired shape.

According to one disclosed embodiment a latch assembly configured to mount an upper punch to an upper beam of a press brake for bending a workpiece is provided. The latch assembly includes a safety latch disposed within a safety latch cavity of the upper punch, wherein the upper punch is partially housed within a first cavity of the upper beam. A biasing member is also disposed within the safety latch cavity and a pin extends from a lateral side of the upper punch through the safety latch. The safety latch is configured to rotate about the pin and includes a safety latch cam configured to engage the upper beam within a second cavity of the upper beam. The biasing member is configured to bias the safety latch cam in a forward direction towards the upper beam cavity to prevent the upper punch from disengaging the upper beam.

According to another disclosed embodiment, a press brake assembly configured to bend a workpiece is provided. The press brake includes an upper beam configured to hold an upper punch and a lower beam configured to hold a lower die. The upper beam is configured to move towards the lower beam such that the upper punch bends the workpiece on the lower die. A safety latch is disposed within a safety latch cavity of the upper punch, and the upper punch is partially housed within a first cavity of the upper beam. A biasing member is also disposed within the safety latch cavity and a pin extends from a lateral side of the upper punch through the safety latch, which is configured to rotate about the pin. The safety latch includes a safety latch cam configured to engage the upper beam within a second cavity of the upper beam. The biasing member is configured to bias the safety latch cam in a forward direction towards the upper beam cavity to prevent the upper punch from disengaging the upper beam.

According to another embodiment, a latch assembly for a press brake upper punch is provided. The latch assembly includes a safety latch disposed within the upper punch and a biasing member housed within the upper punch. The biasing member is configured to bias the safety latch in a forward direction. The assembly also includes a pin extending through the upper punch and safety latch in a lateral direction, wherein the safety latch is configured to rotate around a rotation axis, wherein the rotation axis is coaxial with the longitudinal axis of the pin and the lateral direction. The forward direction is perpendicular to the rotation axis of the safety latch and the lateral direction.

FIG. 1 illustrates an exemplary press brake machine 100. The press brake machine disclosed herein is used to bend or otherwise deform sheet-like workpieces, such as sheet metal workpieces (not shown). The press brake machine may include a controller 400 configured to operate the press brake either manually or autonomously. The controller 400 may also be used to control the movement of the workpiece and any tools associated with the press brake machine. Additional parts such as tooling systems, gauges, and measurements systems disclosed in U.S. application Ser. Nos. 15/814,158, 16/180,983, 16/541,060, 16/541,021, and 16/578,188 (all incorporated by reference herein in its entirety) may be utilized be the press brake machine 100. The press brake machine 100 has an upper beam or ram 110 and a lower beam or bed 120, at least one of which is movable toward and away from the other. Preferably, the upper beam is movable vertically while the lower beam is fixed in a stationary position. As an example, a male forming punch and a female forming die may be mounted respectively on the upper and lower beams of a press brake. Although generally fixed, the position of the lower beam may be adjusted through use of crowning system to ensure consistent bending of longer workpieces.

Figure 2:
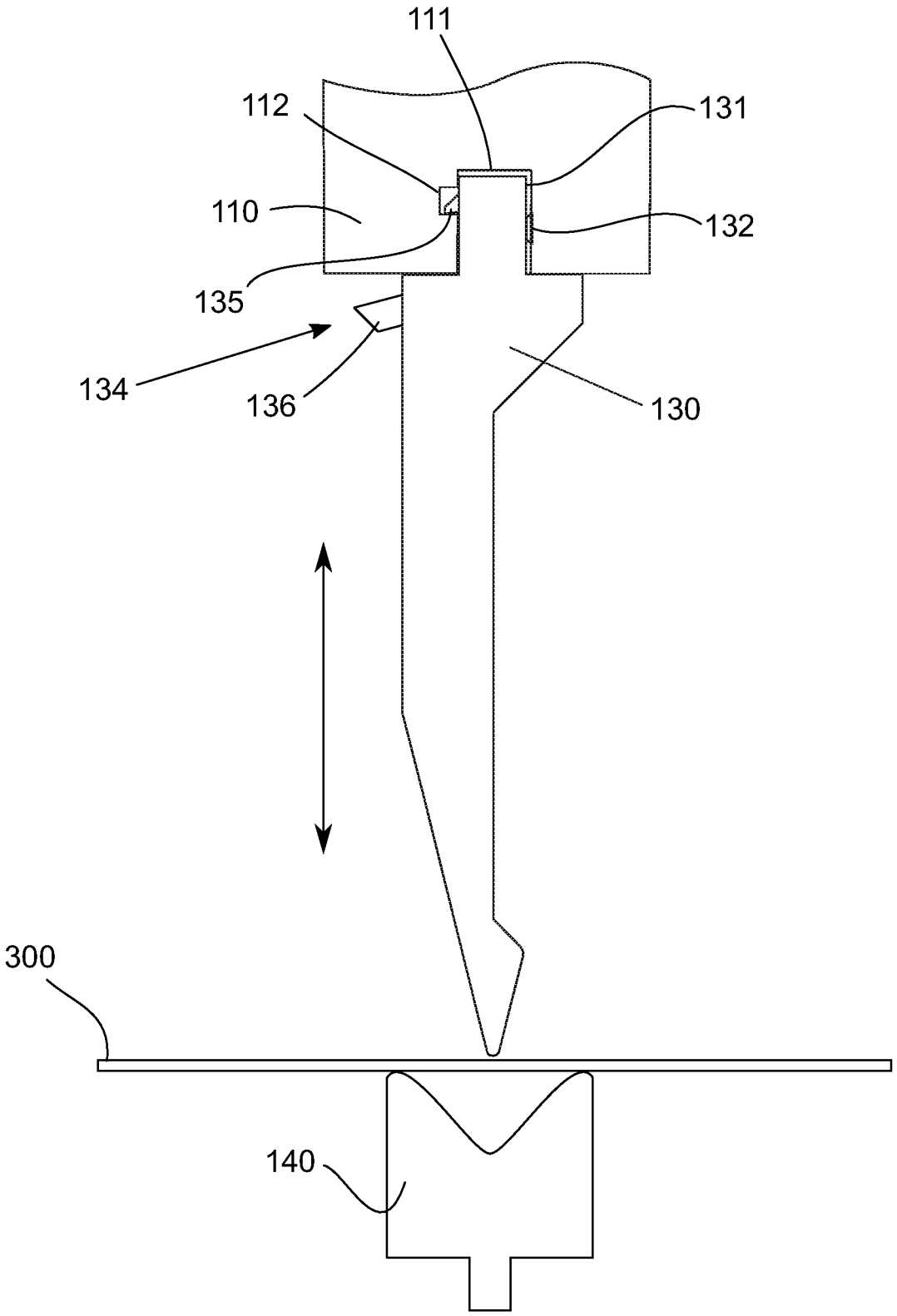
FIG. 2 is a side view of an exemplary safety latch assembly utilized in the press brake shown in FIG. 1.

FIG. 2 shows an isolated sectioned close up 'A', as labeled in FIG. 1, of the upper beam 110 with the upper punch 130, lower die 140, and lower beam 120. The punch 130 projects downward into the die 140. The workpiece 300 is disposed above the die and below the punch 130. The punch 130 includes a workpiece deforming surface at the tip of punch 130. The configuration of this surface is dictated by the shape into which it is desired to deform a workpiece 300. The shape of the work piece is also dependent on the shape of the lower die 140, which can utilize different shapes. When the upper and lower beams 110/120 are brought together, the workpiece 300 located between them is pressed by the punch into the die to give the workpiece a desired deformation (e.g., a desired bend).

The upper punch 130 includes an upper punch tongue 131 punch holder clamping mechanism 132, upper punch safety latch cam 135. The upper punch tongue 131 sits within the upper beam 110 within a first upper beam cavity 111. The punch holder clamping mechanism 132 holds the upper punch 130 to the upper beam 110. The punch holder clamping mechanism 132 may utilize different systems in order to hold the upper punch 130 via clamping pressure (i.e. pushing the upper punch) such as a biasing member or an actuator. The first upper beam cavity has a cross-section corresponding and complementary to the shape of the upper punch tongue 131 such that the cross-sectional shape of the upper beam cavity 111 is substantially similar to the shape of the tongue 131. The upper punch 130 houses an upper punch safety latch 134 with a safety latch cam 135 and safety latch arm 136. The upper beam additionally includes a second upper beam cavity 112. Both the first upper beam cavity 111 and second upper beam cavity 112 may run along the entire length of the beam.

Figure 3:
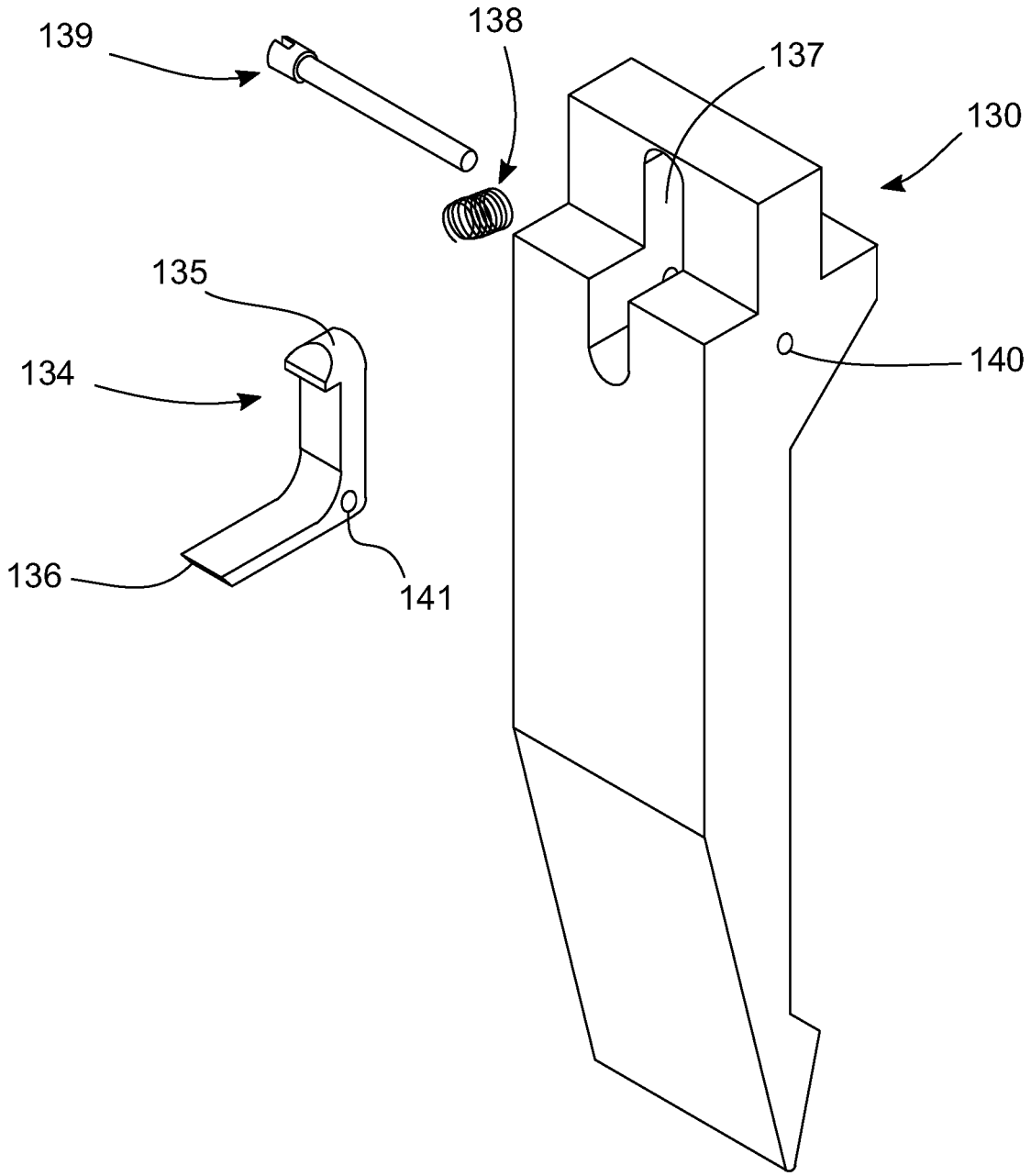
FIG. 3 is an isometric disassembled view of the safety latch assembly.
Figure 4:
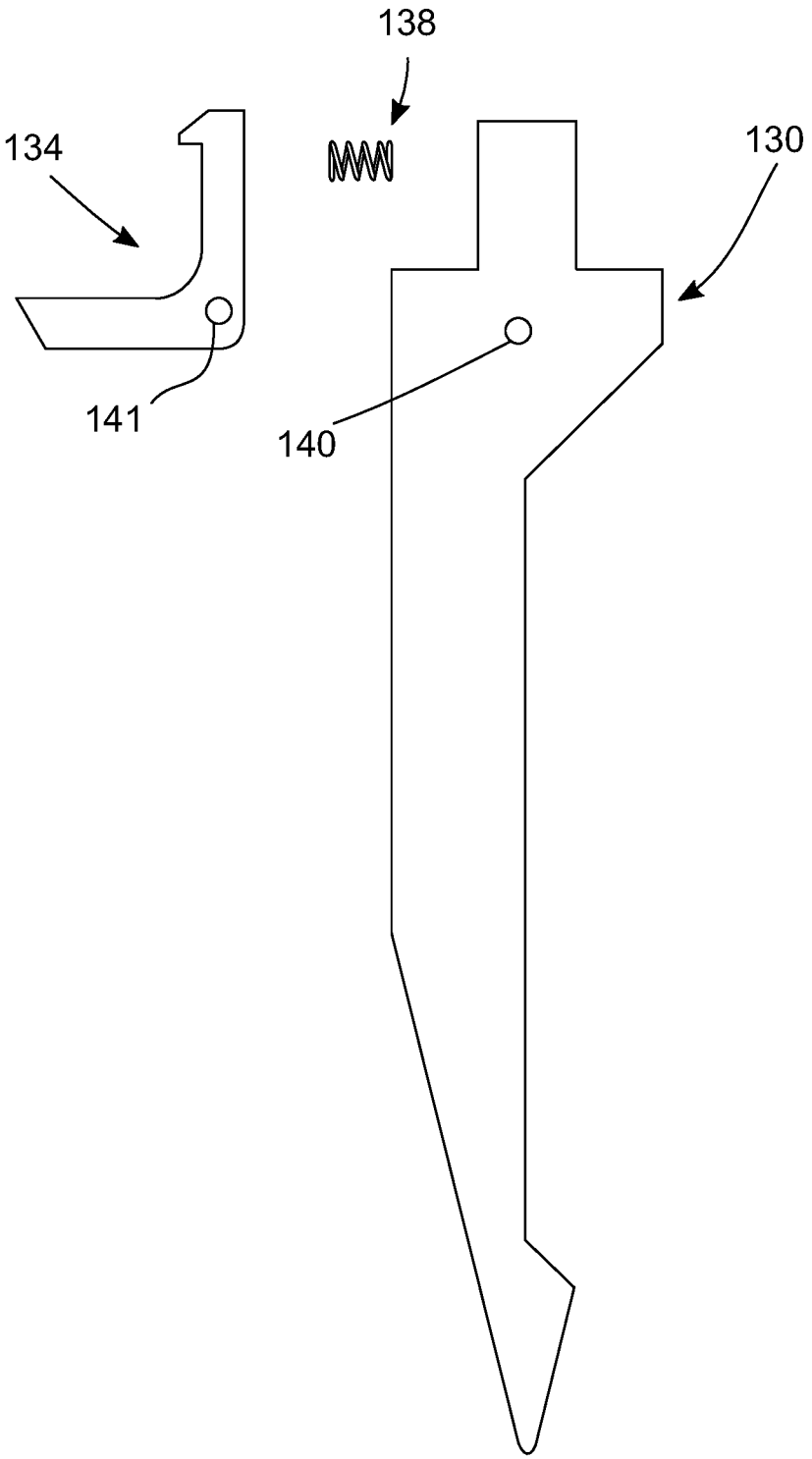
FIG. 4 is a side view of the safety latch assembly.

FIGS. 3 and 4 shows an isolated view of the upper punch 130. The upper punch 130 also includes a safety latch cavity 137 configured to house the safety latch 134 and a biasing spring 138 housed within the tongue 131. The safety latch 134 sits within the cavity 137 and the biasing spring 138 is disposed between the safety latch 134 and the punch 130 at the cam portion 135. The assembly is configured to allow the safety latch 134 to fit within the first safety latch cavity 137 without fully enclosing it, thus preventing accumulation of contaminants to gather and remain unobservable within the safety latch cavity 137. A pin 139 is disposed in a punch pin aperture 140, where the pin is configured to be inserted at a lateral side of the upper punch 130 and extends through the safety latch cavity 137. The pin 139 also extends through a safety latch pin aperture 141 and supports the safety latch 135. The pin 139 acts as a fulcrum in which the safety latch 135 rotates about. The punch pin aperture 140 and the safety latch pin aperture 141 are coaxial in the assembled state so that the pin can slide through. This configuration allows ease of inspection and cleaning of potential contaminants that may reside in the assembly.

Figure 5A:
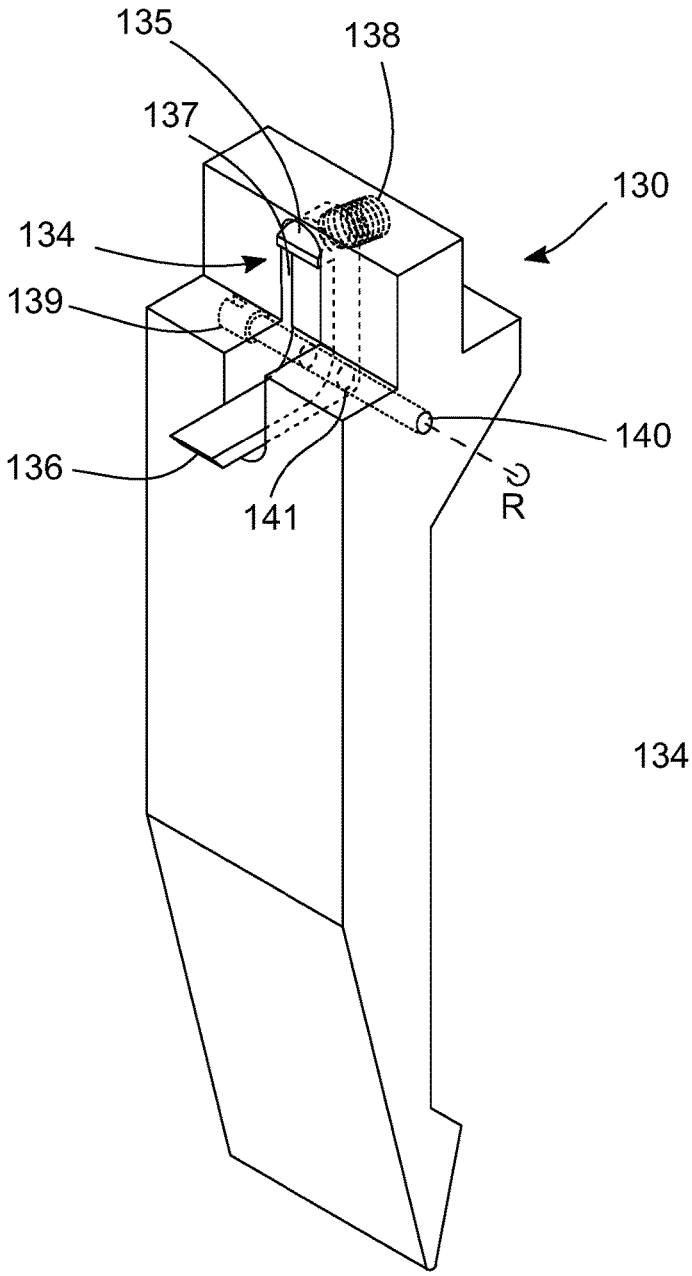
FIG. 5*a* is an isometric view of the safety latch assembly in the assembled state.
Figure 5B:
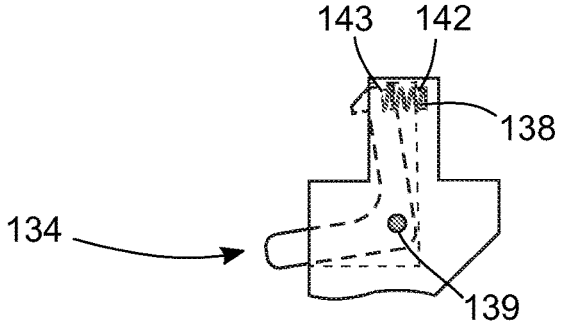
FIG. 5*b* is a side view of the safety latch assembly in the assembled state.

FIG. 5*a* shows the upper punch 130 in an assembled state with the upper beam omitted. The upper die 130 may further include a biasing spring pocket 142, configured to partially hold the biasing spring 138 within the safety latch 137. Similarly, the safety latch may also include a safety latch pocket 143 configured to hold the opposite end of the biasing spring 138. FIG. 5*b* shows a side view of the assembled state.

Figure 6A:
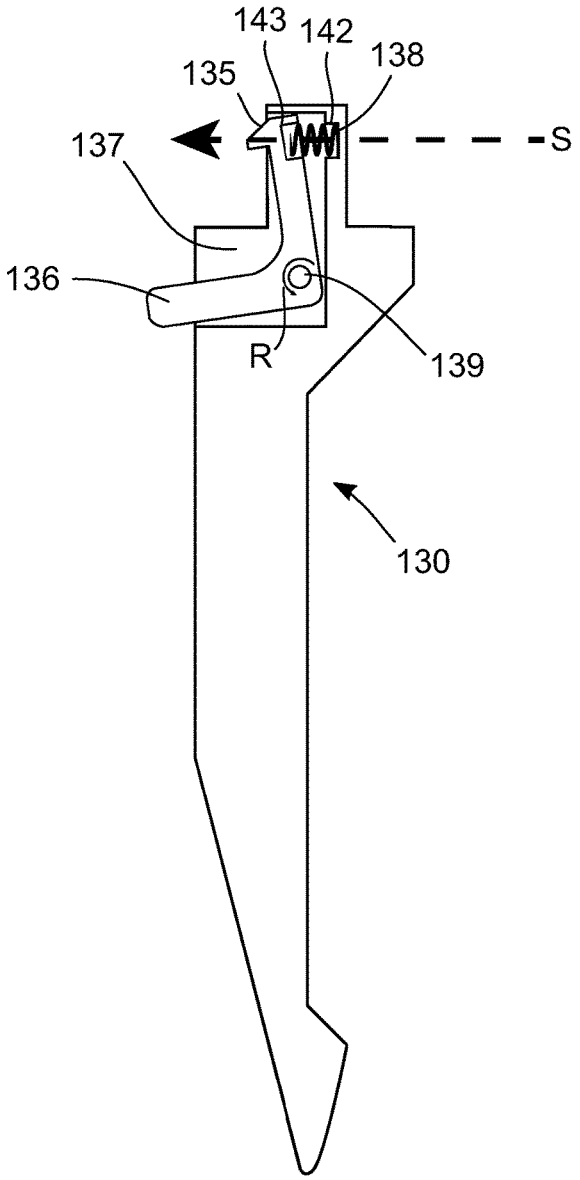
FIG. 6*a* is a sectional side view of the safety latch assembly in an engaged state.
Figure 6B:
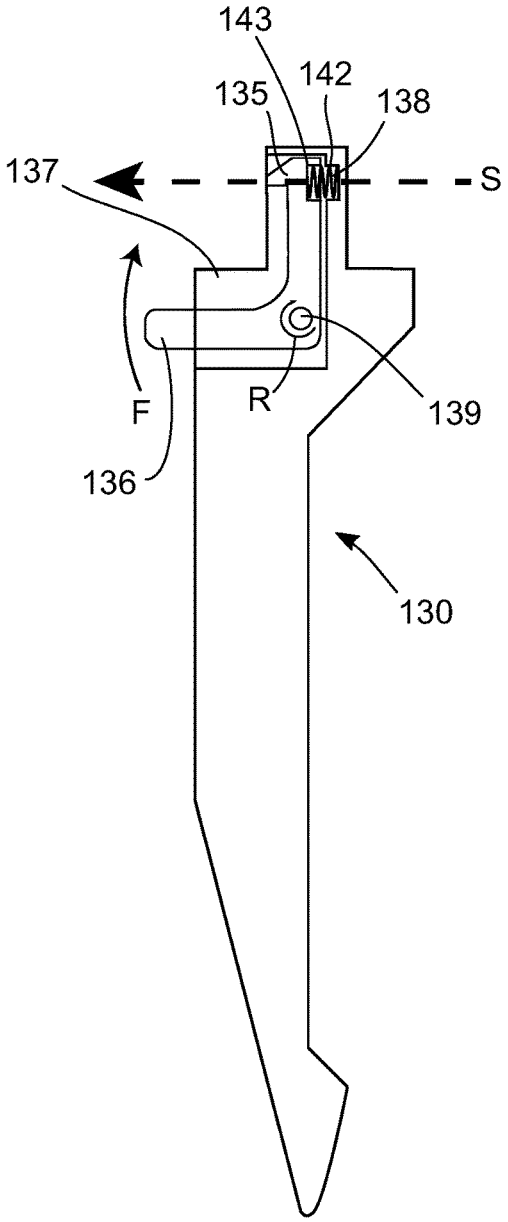
FIG. 6*b* is a sectional side view of the safety latch assembly in a disengaged state.
Figure 7A:
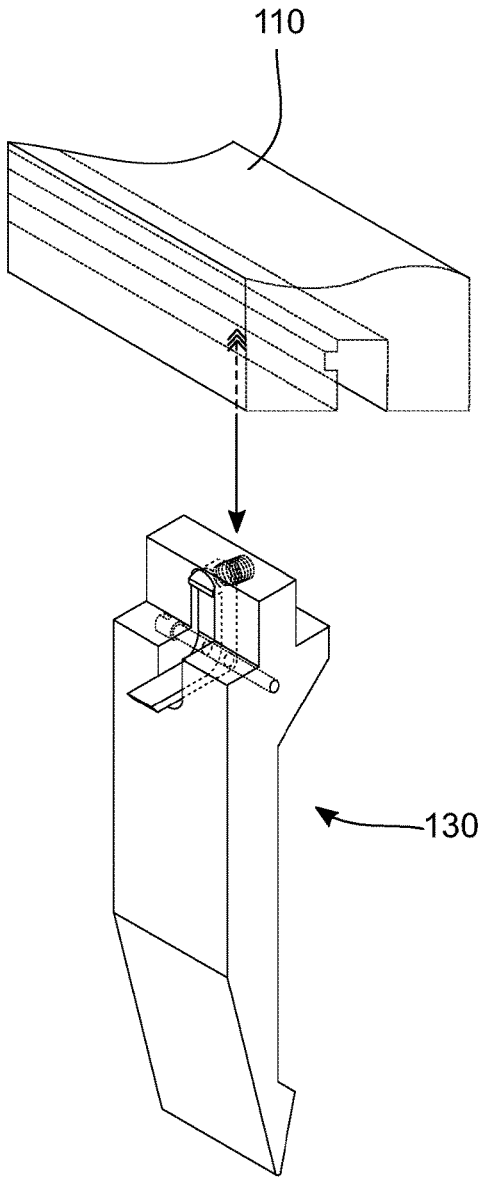
FIG. 7*a* shows an installation procedure of the safety latch assembly wherein a punch is inserted vertically into an upper beam of a press brake.
Figure 7B:
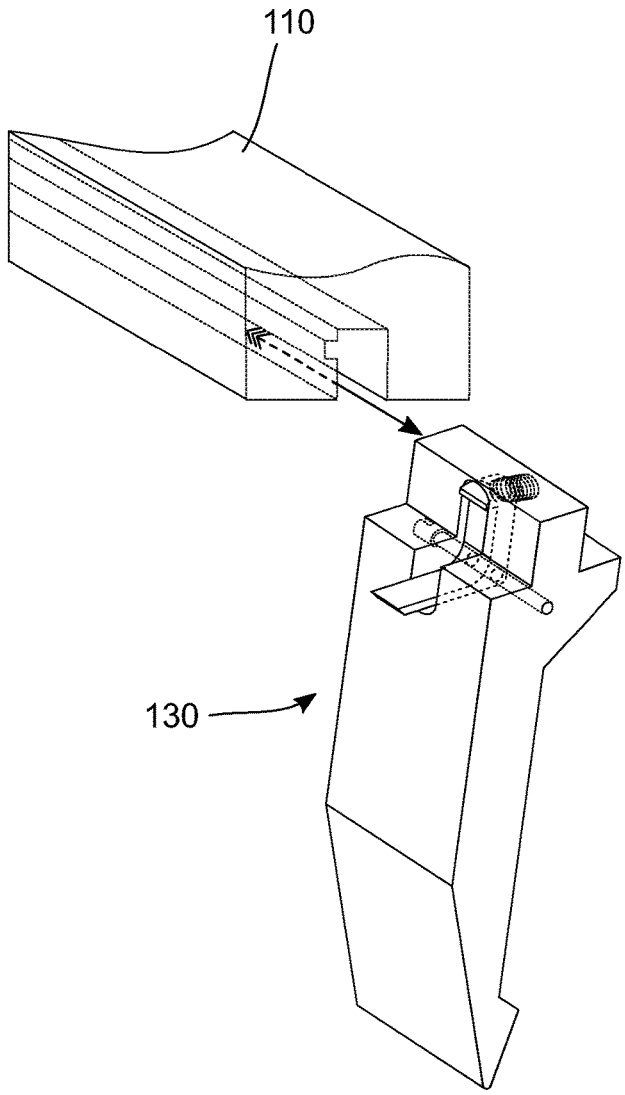
FIG. 7*b* shows an installation procedure of the safety latch assembly wherein a punch is inserted horizontally into an upper beam of a press brake.

FIGS. 6*a* and 6*b* shows two states of the assembly with the safety latch actuated. The force 'S' enacted on the safety latch 134 from the biasing spring 138 will always push the safety latch cam 135 outwards (i.e. towards the upper beam first cavity 111) which is shown in FIG. 6*a*. This biasing force 'S' will prevent the upper punch 130 from falling and to stay within the upper beam 110 via the safety latch 134. An external force 'F' is required in order to rotate the safety latch 134 around the pin 139 to oppose the force 'S', such that the safety latch cam 135 retracts into the safety latch cavity 137 (i.e. away from the upper beam first cavity 111). When the safety latch 134 is actuated, the upper punch 130 may be inserted into the upper beam 110 either from the bottom (i.e. vertically) or from the sides (i.e. horizontally) of the upper beam as shown in FIGS. 7*a* and 7*b*. The embodiment shown is not exclusive to a single safety latch design. Multiple safety latches may be disposed along the length of the punch 130 for longer and heavier upper punches. The direction of force 'S' may be perpendicular to the rotation axis 'R' about the pin 139. The rotation axis 'R' is coaxial and congruent with the longitudinal axis of the pin.

With this configuration shown in the figures and described above, in the event of a failure of any components within the assembly such as the safety latch 134 or pin 139, the biasing spring 138 is configured to maintain pressure against the safety latch in order to prevent the tool from falling if clamping pressure from the clamping mechanism 132 is released from the upper punch tongue 131. The safety latch 134 may be utilized in a variety of punch shapes and sizes, the punch 130 shown and described herein are merely exemplary. Additionally, different variations of the safety latch shape may be utilized in order to accommodate to different punch holders (e.g. upper beam members). Cavities and pockets described herein may be created via machining or milling.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the vehicle network system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A latch assembly configured to mount an upper punch to an upper beam of a press brake for bending a workpiece, the latch assembly comprising:

a safety latch disposed within a safety latch cavity of the upper punch, wherein the upper punch is partially housed within a first cavity of the upper beam;

a biasing member also disposed within the safety latch cavity;

a pin extending from a lateral side of the upper punch through the safety latch, wherein the safety latch is configured to rotate about the pin;

the safety latch including a safety latch cam configured to engage the upper beam within a second cavity of the upper beam, wherein the biasing member is configured to bias the safety latch cam in a forward direction towards the upper beam cavity to prevent the upper punch from disengaging the upper beam;

wherein the safety latch comprises a safety latch arm;

wherein the safety latch arm is connected at one end to the pin and is configured so that upwards force directly enacted on an other end of the safety latch arm disengages the safety latch cam from the upper beam; and wherein the safety latch arm is angled downwards when the safety latch cam is engaged.

2. The latch assembly of claim 1, further comprising:

a safety latch pocket disposed on the upper side of the safety latch and adjacent the safety latch cam, wherein the safety latch pocket is configured to hold one end of the biasing member;

a biasing member pocket disposed within the upper die configured to hold another other end of the biasing member.

3. The latch assembly of claim 1, wherein the upper punch includes a tongue disposed at the upper end of the upper punch, the tongue configured to be inserted in the first cavity of the upper beam.

4. The latch assembly of claim 3, wherein the safety latch arm is disposed outside of the first cavity of the upper beam.

5. The latch assembly of claim 4, wherein the safety latch arm is configured to be lower than the pin when the safety latch cam is engaged.

6. The latch assembly of claim 3, wherein the first upper beam cavity has a cross-section corresponding and complementary to the shape of the upper punch tongue such that the cross-sectional shape of the upper beam cavity is substantially similar to the shape of the tongue.

7. The latch assembly of claim 3, wherein the tongue is configured to engage a clamping mechanism, wherein the clamping mechanism is located opposite of the safety latch cam relative to the tongue.

8. The latch assembly of claim 1, wherein the safety latch cavity of the upper punch is open in the forward direction.

9. The latch assembly of claim 1 wherein the safety latch arm is monolithic to the safety latch cam.

10. A latch assembly configured to mount an upper punch to an upper beam of a press brake for bending a workpiece, the latch assembly comprising:

a safety latch disposed within a safety latch cavity of the upper punch, wherein the upper punch is partially housed within a first cavity of the upper beam;

a biasing member also disposed within the safety latch cavity;

a pin extending from a lateral side of the upper punch through the safety latch, wherein the safety latch is configured to rotate about the pin;

the safety latch including a safety latch cam configured to engage the upper beam within a second cavity of the upper beam, wherein the biasing member is configured to bias the safety latch cam in a forward direction towards the upper beam cavity to prevent the upper punch from disengaging the upper beam;

wherein the safety latch comprises a safety latch arm;

wherein the safety latch arm is positioned below the pin when the safety latch is engaged with the upper beam and wherein the safety latch arm is configured to be pushed upwards to disengage the safety latch cam from the upper beam; and wherein the safety latch arm is angled downwards when the safety latch cam is engaged.

11. The latch assembly of claim 10, wherein the safety latch arm is connected to the pin.

12. The latch assembly of claim 10, wherein the pin extends from the lateral side of the upper punch to another lateral side of the upper punch.

13. A latch assembly configured to mount an upper punch to an upper beam of a press brake for bending a workpiece, the latch assembly comprising:

a safety latch disposed within a safety latch cavity of the upper punch, wherein the upper punch is partially housed within a first cavity of the upper beam;

a biasing member also disposed within the safety latch cavity;

a pin extending from a lateral side of the upper punch through the safety latch, wherein the safety latch is configured to rotate about the pin;

the safety latch including a safety latch cam configured to engage the upper beam within a second cavity of the upper beam, wherein the biasing member is configured to bias the safety latch cam in a forward direction towards the upper beam cavity to prevent the upper punch from disengaging the upper beam;

wherein the safety latch comprises a first arm continuously extending from the pin in a first direction and a second arm continuously extending from the pin in a second direction, such that the first arm and second arm are monolithic;

wherein the second arm is configured to be directly pushed upwards to disengage the safety latch cam from the upper beam; and wherein the second arm is angled downwards when the safety latch cam is engaged.

14. The latch assembly of claim 13, wherein the pin extends from the lateral side of the upper punch to another lateral side of the upper punch.

* * * * *